US005288252A

United States Patent [19]

Steinhardt et al.

[11] Patent Number: 5,288,252

[45] Date of Patent: Feb. 22, 1994

[54] FLAT-CONTACT PLUG SOCKET

[75] Inventors: Helmut Steinhardt; Rudolf Nottrott, both of Nürnberg, Fed. Rep. of Germany

[73] Assignee: TRW Daut + Rietz GmbH & Co. KG, Nuremberg, Fed. Rep. of Germany

[21] Appl. No.: 866,181

[22] PCT Filed: Oct. 24, 1991

[86] PCT No.: PCT/EP91/02018

§ 371 Date: Jun. 25, 1992

§ 102(e) Date: Jun. 25, 1992

[87] PCT Pub. No.: WO92/09120

PCT Pub. Date: May 29, 1992

[30] Foreign Application Priority Data

Nov. 9, 1990 [DE] Fed. Rep. of Germany ..... 4035613

[51] Int. Cl.[5] ..... H01R 4/48

[52] U.S. Cl. ..... 439/839; 439/851

[58] Field of Search ..... 439/849, 850, 830, 833, 439/839, 842, 843, 851, 856, 861, 862

[56] References Cited

U.S. PATENT DOCUMENTS 4,540,235 9/1985 Lolic ..... 439/839

5,007,865 4/1991 Jackobeit ..... 439/839

FOREIGN PATENT DOCUMENTS 3730676 9/1988 Fed. Rep. of Germany ..... 439/839

*Primary Examiner*—David L. Pirlot

*Attorney, Agent, or Firm*—Collard & Roe

[57] ABSTRACT

In a flat contact socket with two spring contact arms elastically touching at a distance from the free ends over part of their length, arranged on the socket body and bent back at the free ends, and with outer springs supported on the contact arms or the purposes of easy and secure insertion of the flat contact socket into the socket housing, the socket body is firmly surrounded by an outer spring body and the outer spring body is provided at the diameter wall sections with arm parts, extending over the flat sides of the contact arms and obliquely to the free ends and to one another. In addition, the free ends of the arm parts are bent back over part of their length over the free ends of the contact arms against one another and in the insertion direction and arranged to press against the free ends of the contact arms.

8 Claims, 1 Drawing Sheet

FLAT-CONTACT PLUG SOCKET

BACKGROUND OF THE INVENTION

1. Field of the Invention

The invention relates to a flat-contact plug socket with two contact arms arranged on the body of the socket. These arms are bent back at the free end and, within the spacing of the free end, rest against each other across part of their length with resilient elasticity, as well as with outer springs supported on the contact arms.

2. The Prior Art

It is known that plug socket casings are mechanically equipped with flat-contact plug sockets. The problem arising in the course of the connecting operation is that the free ends of the flat-contact plug sockets often get hooked onto areas of the casing, causing an unfavorable result when using this device. In addition, it has been found that the probability of getting hooked increases as the sizes of plug socket casings and plug sockets become smaller. In particular, however, such getting hooked by the flat-contact plug sockets occurs as the latter are being inserted into plug socket casings when outer springs are associated with the contact arms of the flat-contact plug sockets.

SUMMARY OF THE INVENTION

It is an object of the present invention to provide for measures which safely permit a trouble-free insertion of small-sized flat-contact plug sockets in plug socket casings.

According to the present invention, this object is achieved in that the body of the socket is rigidly embraced by the outer spring body; that on diameter wall segments, the outer spring body has an arm part extending in each case over the flat sides of the contact arms inclined relative to the free ends and against each other. The free ends of the arm parts are partially bent lengthwise, back over the free ends of the contact arms against one another and in the plugging direction, and pressingly resting against the free ends of the arm parts. In this way, guide surfaces are formed by the arm parts for slidingly guiding the contact arms along surfaces of the casing, whereby the sliding effect of the arm parts is supported by the bend ends.

In one embodiment of the flat-contact plug socket, the outer spring body and the arm parts can be formed as one piece. The outer spring body and the arm parts are preferably cut from one piece of sheet metal and have to be straightened out by bending and/or folding. Usefully, the arm parts have a slightly lesser width than the width of the contact arms, and slit lengthwise at least approximately up to the outer spring body for enhancing the elasticity property within the spacing of the free ends.

In another embodiment of the flat-contact plug socket, provision is made for fixing the outer spring body on the socket body by inwardly bending clips over marginal strips of recesses formed in the socket body. It is understood that the outer spring body can be connected with the socket body also in any other desired way. For example, it is possible to secure the outer spring body and the socket body on one another by welding or soldering.

In yet another embodiment of the flat-contact plug socket, provision is made for providing the outer spring body and the socket body with coaxial recesses for having a locking tongue gripping through such recesses. This locking tongue is arranged with resilient elasticity on the casing of the plug socket. In this way, the outer spring body supports the displacement-free attaching of the flat-contact plug socket in the plug socket casing.

Finally, a method is provided for the manufacture of the outer spring in that the outer spring body and the two arm parts are cut from one plane piece of sheet metal on and jointly with a transport strip with spacing holes, leaving a link with said transport strip that the outer spring body and the arm parts are subsequently folded or bent and the transport strip is wound into a coil; and that for applying the outer spring to the socket body, it is separated from the transport strip within the zone of the bend.

BRIEF DESCRIPTION OF THE DRAWINGS

The invention is explained in greater detail by reference to an exemplified embodiment shown in the drawings, in which.

DETAILED DESCRIPTION OF PREFERRED EMBODIMENT

Figure 1:
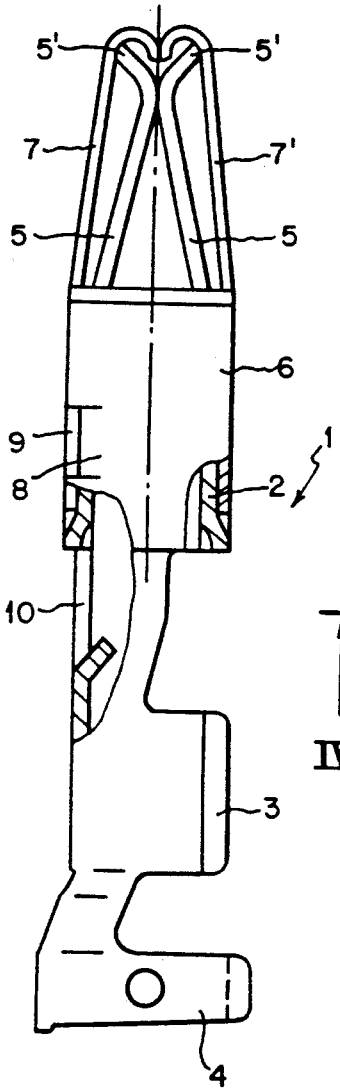
FIG. 1 shows a lateral view of a flat-contact plug socket.
Figure 3:
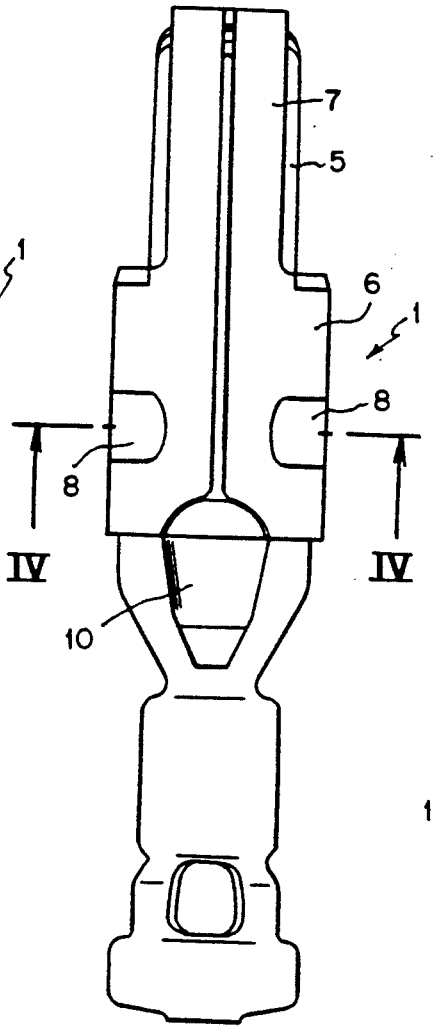
FIG. 3 shows a back view of a flat-contact plug socket.
Figure 2:
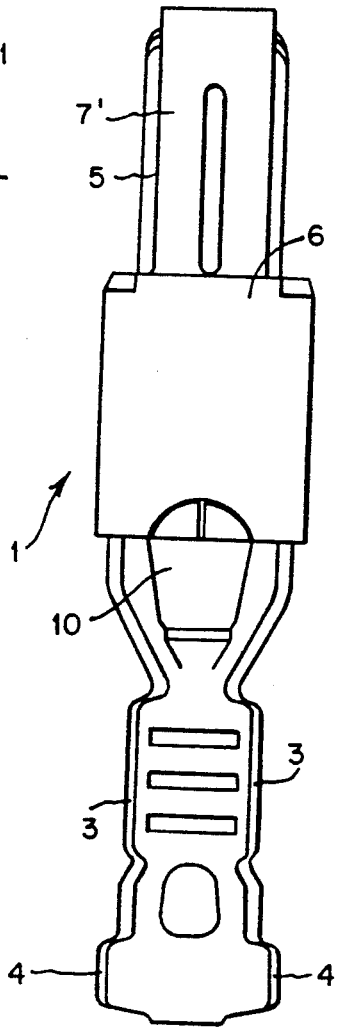
FIG. 2 shows a front view of a flat-contact plug socket.
Figure 4:
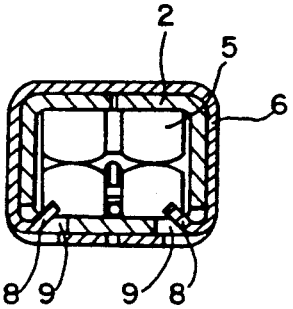
FIG. 4 shows a section according to line IV—IV in FIG. 3.

Turning now in detail to the drawings, FIG. 1 shows a flat-contact plug socket 1 having a socket body 2 joined adjacent to the one end by the crimp attachments 3 and 4 for attaching electrical conductors or the insulation (not shown), whereas the contact arms 5 are formed adjacent to the other end. The free ends of the contact arms 5 are bent back outwardly over a partial length 5' for forming plug-in bevels for contact blades (not shown). An outer spring body 6 is applied to the socket body 2. This outer spring body 6 has the cut arm parts 7, 7' extending inclined relative to one another in the direction of the free ends across the flat sides of the contact arms and abutting with a preset tension against the free ends of the contact arms 5. Within the zone of their free ends, the arm parts 7, 7' are bent back toward one another and in the plug direction. In this way, curved insertion surfaces for contact blades (not shown) are obtained. The strip parts contribute to the support of the contact force of the contact arms. Furthermore, they provide for reducing the force required for insertion of the contact blades and, when plug socket casings are equipped with the flat-contact plug sockets, they prevent the latter from knocking against or getting hooked up with areas of the casing. The multiple function of he outer spring 6, 7, 7' has a particularly favorable effect with small-sized flat-contact plug sockets. This is because getting hooked on surfaces of the casing is increasingly possible with these small-sized sockets.

The outer spring body 6 is attached to the socket body 2 by bending the clips 8 into the recesses 9 of the socket body 2.

In the embodiment shown in the drawings, each contact arm 5 is gripped by one single strip part 7 or 7' extending approximately across the total width of the contact arm 5. In a further embodiment, it is possible also to arrange a number of arm parts 7, 7' of a narrow width on an outer spring body 6 with their ends bent toward one another and in the plugging direction.

For the manufacture of the outer spring 6, 7, 7' it is proposed to cut the outer spring body 6 and the arm parts 7, 7' jointly with a transport strip from one plane shaped metal sheet part. Thus, the outer spring body 6 remains connected to the transport strip trough a link. For applying the outer spring 6, 7, 7' to the socket body 2, the outer spring 6, 7, 7' is separated from he transport strip within the zone of the link, pushed over he socket body 2, and secured on the latter by bending the clips 8 into the recesses 9.

Recess 10 is used for connecting the flat-contact plug socket with the plug socket casing by inserting elastic locking tongues formed on the plug socket casing into said recesses.

We claim:

1. Flat-contact plug socket comprising a connecting area for an electrical conductor;

a socket body with at least two oppositely arranged contact arms on the socket body, said contact arms having free ends and being bent back at the free ends and elastically abutting each other over partial lengths in an interval of the free ends in the direction of the socket body;

an outer spring attached at its base on the socket body and provided with at least two outer spring arm parts on opposite wall segments, the outer spring arm parts abutting the contact arms;

the arm parts each having a free end and said free ends of the outer spring arm parts being bent back towards each other and in a plugging direction, said arm parts being partially bent back over the free ends of the contact arms, and said arm parts being pressed onto the free ends of the contact arms.

2. Flat-contact plug socket as defined in claim 1, wherein the outer spring body and the arm parts are integrally formed.

3. Flat-contact plug socket as defined in claim 1, wherein the arm parts have a slightly smaller width than the width of the contact arms.

4. Flat-contact plug socket as defined in claim 1, wherein the arm parts have free ends and a spacing therebetween, and wherein within the spacing of the free ends, the arm parts are slit lengthwise at least approximately up to the outer spring body.

5. Flat-contact plug socket as defined in claim 1, wherein the socket body has recesses having marginal strips; and wherein the outer spring body is attachable on the socket body by bending clips across the marginal strips of recesses formed in the socket body.

6. Flat-contact plug socket as defined in claim 1, wherein the outer spring body and the socket body are joined with one another by welding or soldering.

7. Flat-contact plug socket comprising a connecting area for an electrical conductor;

a socket body with at least two oppositely arranged contact arms on the socket body, said contact arms having free ends and being bent back at the free ends and elastically abutting each other over partial lengths in an interval of the free ends in the direction of the socket body;

an outer spring attached at its base on the socket body and provided with at least two outer spring arm parts on opposite wall segments, the outer spring arm parts abutting the contact arms;

the arm parts each having a free end and said free ends of the outer spring arm parts being bent back towards each other and in a plugging direction, said arm parts being partially bent back over the free ends of the contact arms, and said arm parts being pressed onto the free ends of the contact arms; and the outer spring body and the socket body having coaxial recesses for connecting a locking tongue formed elastically on the socket body of the plug socket.

8. Method for manufacturing an outer spring comprising the steps of:

cutting from a flat metal sheet a base of an outer spring together with overspring arm parts so as to leave a link connection on a transport strip provided with spacing holes;

subsequently folding the base of the outer spring and the outer spring arms in order to form the outer spring;

winding the transport strip into a coil; and separating the outer spring from the transport strip in an area of the link connection for attachment onto a socket body.

* * * * *